US008864520B2

(12) United States Patent
Lan

(10) Patent No.: US 8,864,520 B2
(45) Date of Patent: Oct. 21, 2014

(54) ELECTRICAL CONNECTOR

(71) Applicant: Cheng Uei Precision Industry Co., Ltd., New Taipei (TW)

(72) Inventor: Rong-Qin Lan, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 199 days.

(21) Appl. No.: 13/693,582

(22) Filed: Dec. 4, 2012

(65) Prior Publication Data

US 2014/0154917 A1 Jun. 5, 2014

(51) Int. Cl.

| | |
|---|---|
| ***H01R 13/648*** | (2006.01) |
| ***H01R 24/00*** | (2011.01) |
| ***H01R 12/71*** | (2011.01) |
| *H01R 12/70* | (2011.01) |
| *H01R 12/72* | (2011.01) |

(52) U.S. Cl.

CPC ..... *H01R 12/714* (2013.01); *H01R 12/7052* (2013.01); *H01R 12/724* (2013.01)

USPC ..... 439/607.01; 439/660; 439/607.07; 439/607.55; 439/620.19; 439/607.14

(58) Field of Classification Search

USPC ..... 439/607.01, 607.24, 607, 46, 607.47, 439/620.06, 620.15, 607.35–607.4, 439/607.51–607.56, 660, 79, 686, 315, 489, 439/490, 540.1, 541.5, 356–358

See application file for complete search history.

(56) References Cited

U.S. PATENT DOCUMENTS

D680,962 S * 4/2013 Lan ..... D13/147
8,801,467 B2 * 8/2014 Lan ..... 439/607.36

* cited by examiner

*Primary Examiner* — Renee Luebke
*Assistant Examiner* — Harshad Patel
(74) *Attorney, Agent, or Firm* — WPAT, P.C.; Anthony King

(57) ABSTRACT

An electrical connector includes a main housing, an inner housing assembled in the main housing, and a plurality of conductive terminals of which each has a fastening arm molded in the inner housing, a contact arm and a touching arm perpendicular to the contact arm. The contact arms are apart arranged along a transverse direction in front of the inner housing. The touching arms are apart arranged along a longitudinal direction at one side of the inner housing. In use, the touching arms of the conductive terminals are elastically against and further pressed downward by a circuit board to realize electrical connection with the circuit board. It is rather short-time and convenient for mounting the circuit board to the electrical connector. Moreover, the touching arms of the conductive terminals are easily removed from the circuit board for the convenience of replacing the electrical connector when it doesn't work.

10 Claims, 5 Drawing Sheets

ELECTRICAL CONNECTOR

BACKGROUND OF THE INVENTION

1. Field of the Invention

The present invention generally relates to an electrical connector, and more particularly to an electrical connector capable of being mounted to and removed from a circuit board conveniently.

2. The Related Art

It is well known that electrical connectors are widely used in electronic products to electrically connect with a circuit board. Traditionally, the electrical connector is connected with the circuit board by soldering terminals thereof to the circuit board by means of a SMT method. As a result, it is rather time-consuming and inconvenient for mounting the electrical connector to the circuit board. Moreover, when the electrical connector needs to be replaced because it doesn't work, it will be an arduous task to remove the terminals from the circuit board, and the circuit board is easily damaged by inappropriate operations. So, an electrical connector capable of being mounted to and removed from a circuit board conveniently is required.

SUMMARY OF THE INVENTION

An object of the present invention is to provide an electrical connector which includes a main housing, an inner housing, a plurality of conductive terminals and a shielding shell. The main housing has a base body, a tongue board extending forward from a front of the base body, and a bearing board extending sideward from one side face of the base body. A top face of the bearing board defines a receiving cavity penetrating rearward through the bearing board. A back of the base body is concaved forward to form a receiving chamber penetrating sideward through the base body to communicate with the receiving cavity. The inner housing is disposed in the receiving chamber of the main housing. The conductive terminals each has a fastening arm placed horizontally. One end of the fastening arm extends forward and is arched upward to form a contact arm, and the other end of the fastening arm extends sideward and is arched upward to form a touching arm perpendicular to the contact arm. The fastening arms are apart molded in the inner housing. The contact arms are arranged at regular intervals along a transverse direction in front of the inner housing and elastically project beyond a top face of the tongue board. The touching arms are arranged at regular intervals along a longitudinal direction at one side of the inner housing. The touching arms are received in the receiving cavity of the main housing and elastically project upward beyond the top face of the bearing board. The shielding shell encloses the main housing and the inner housing. In use, an external circuit board is horizontally mounted on the bearing board with the touching arms of the conductive terminals being elastically against and further pressed downward by the circuit board to realize electrical connection with the circuit board.

As described above, the electrical connector and the circuit board are electrically connected with each other by way of the touching arms of the conductive terminals elastically abutting against the circuit board. It is rather short-time and convenient for mounting the circuit board to the electrical connector. Moreover, the touching arms of the conductive terminals are easily removed from the circuit board for the convenience of replacing the electrical connector when it doesn't work.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
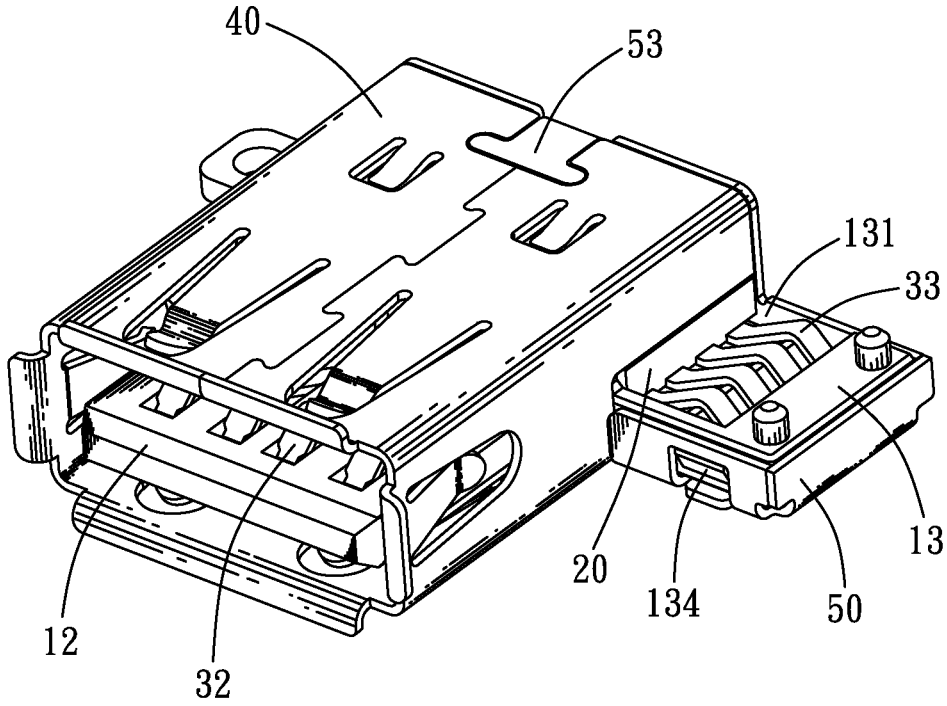
FIG. 1 is an assembled perspective view of an electrical connector according to an embodiment of the present invention.
Figure 2:
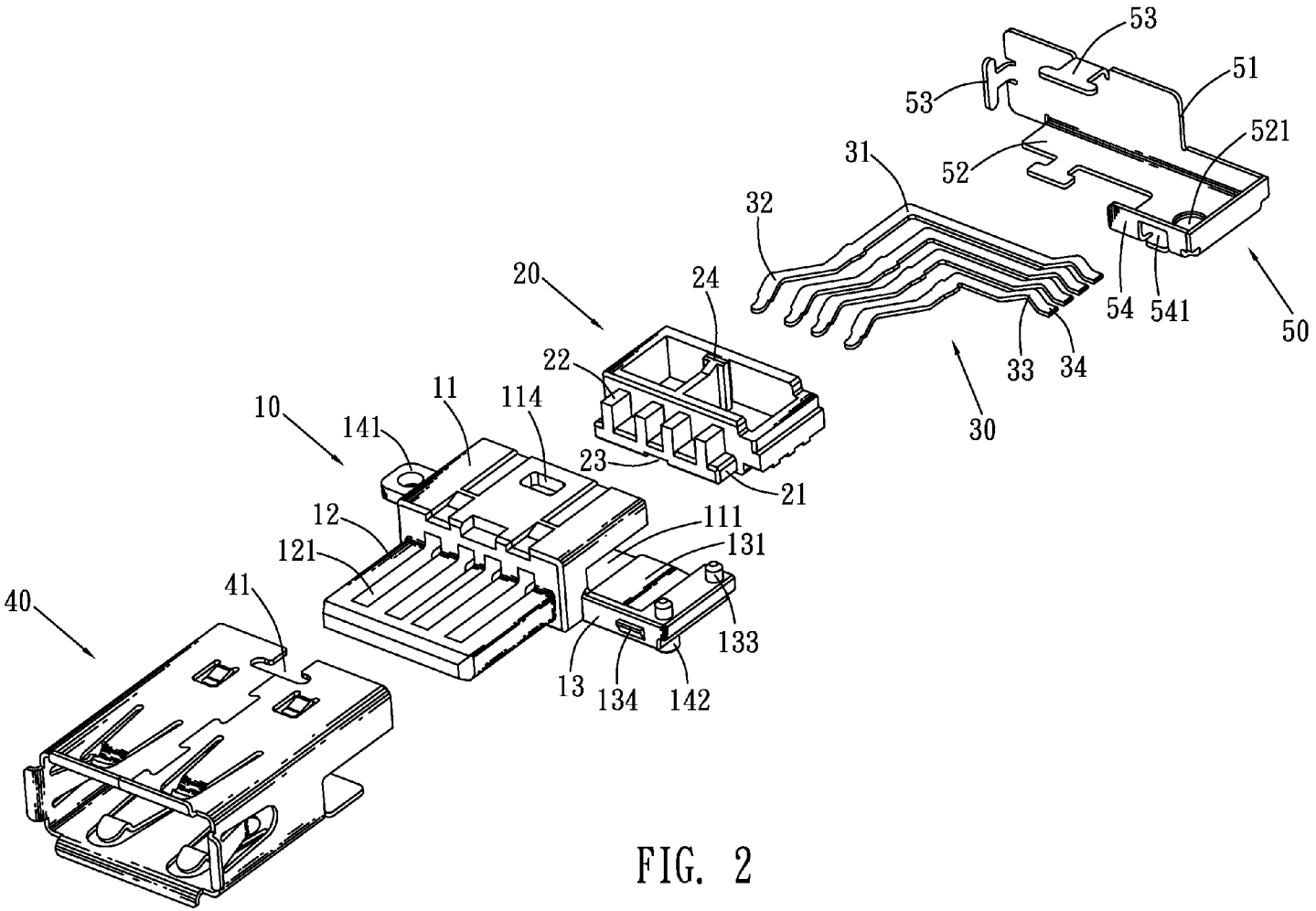
FIG. 2 is an exploded perspective view of the electrical connector of FIG. 1.

With reference to FIG. 1 and FIG. 2, an electrical connector in accordance with an embodiment of the present invention includes a main housing 10, an inner housing 20, a plurality of conductive terminals 30 and a shielding shell.

Referring to FIG. 1, FIG. 2, FIG. 4 and FIG. 5, the main housing 10 has a base body 11, a tongue board 12 extending forward from a front of the base body 11, and a bearing board 13 extending sideward from one side face of the base body 11. A top face of the bearing board 13 defines a receiving cavity 131 penetrating rearward through the bearing board 13. A back of the base body 11 is concaved forward to form a receiving chamber 111 penetrating sideward through the base body 11 to communicate with the receiving cavity 131. The inner housing 20 is disposed in the receiving chamber 111 of the main housing 10.

The conductive terminals 30 each has a fastening arm 31 placed horizontally. One end of the fastening arm 31 extends forward and is arched upward to form a contact arm 32, and the other end of the fastening arm 31 extends sideward and is arched upward to form a touching arm 33 perpendicular to the contact arm 32. The fastening arms 31 are apart molded in the inner housing 20. The contact arms 32 are arranged at regular intervals along a transverse direction in front of the inner housing 20 and elastically project beyond a top face of the tongue board 12. The touching arms 33 are arranged at regular intervals along a longitudinal direction at one side of the inner housing 20. The touching arms 33 are received in the receiving cavity 131 of the main housing 10 and elastically project upward beyond the top face of the bearing board 13. The shielding shell encloses the main housing 10 and the inner housing 20.

In use, an external circuit board 80 is horizontally mounted on the bearing board 13 with the touching arms 33 of the conductive terminals 30 being elastically against and further pressed downward by the circuit board 80 to realize electrical connection with the circuit board 80. The top face of the bearing board 13 of the main housing 10 protrudes upward to form a pair of fastening pillars 133 inserted in the circuit board 80 to secure the circuit board 80 on the bearing board 13. So, it is short-time and convenient to mount the circuit board 80 to the electrical connector and remove the circuit board 80 from the electrical connector.

Figure 3:
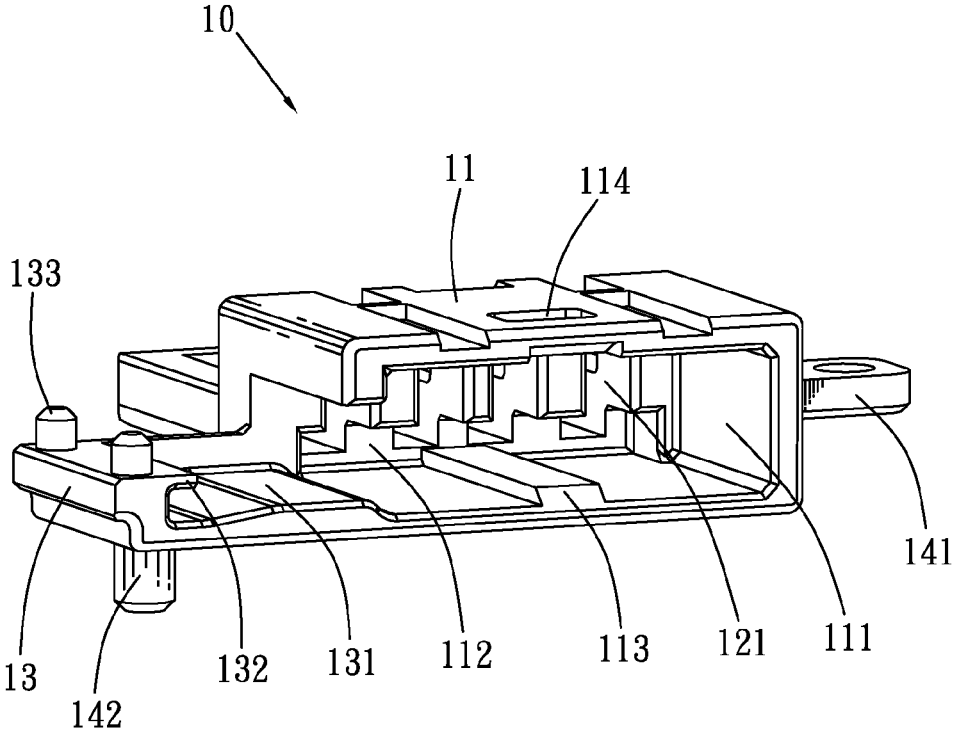
FIG. 3 is a perspective view of a main housing of the electrical connector of FIG. 2.
Figure 4:
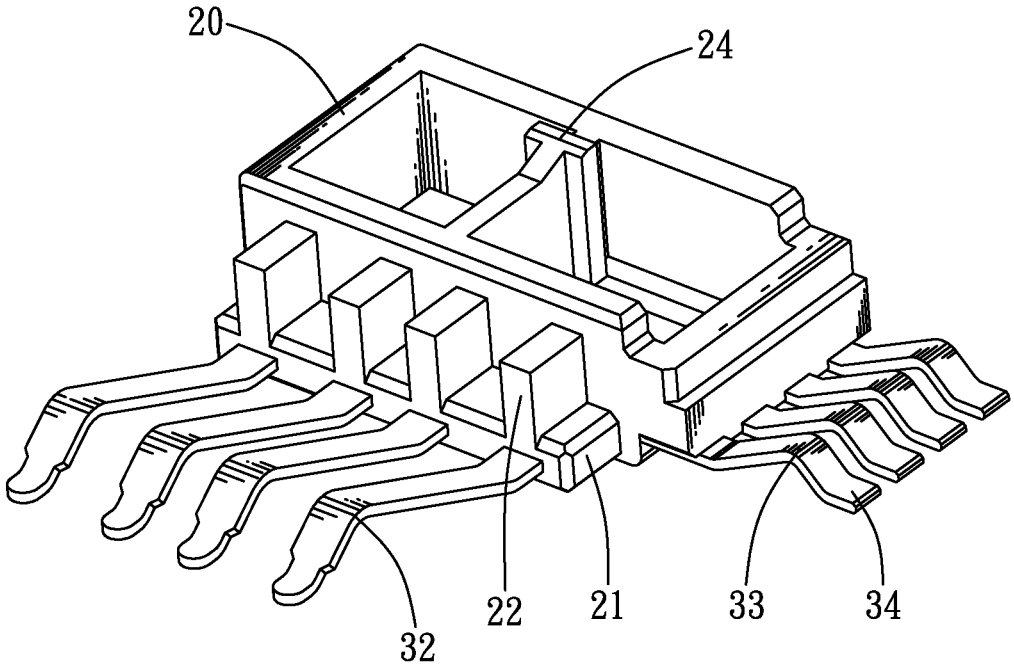
FIG. 4 is a perspective view showing that a plurality of conductive terminals are molded in an inner housing of the electrical connector of FIG. 2.
Figure 5:
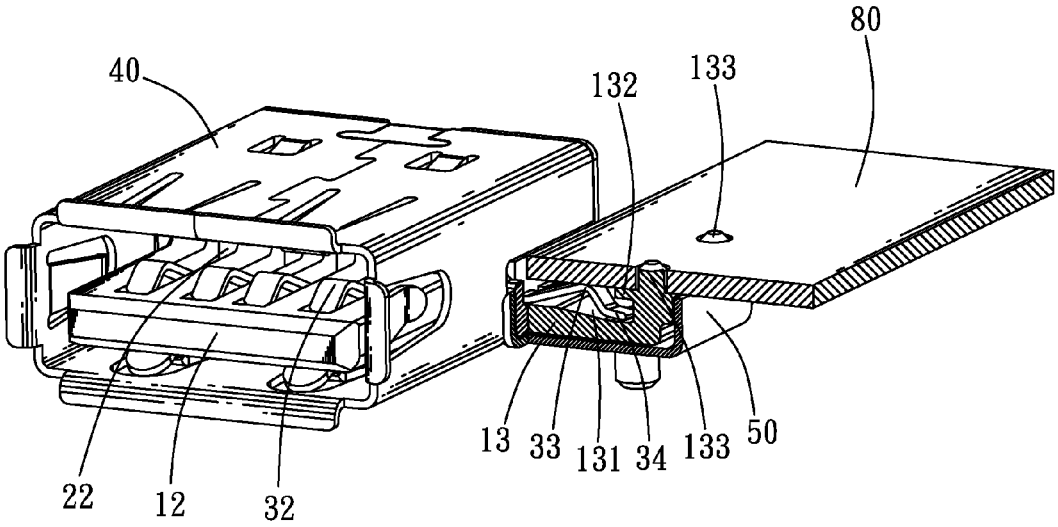
FIG. 5 is a partially sectional view showing that a circuit board is mounted to the electrical connector of FIG. 1.

Referring to FIG. 2, FIG. 3 and FIG. 5, the fastening arm 31 of the conductive terminal 30 is substantially of a lying-L shape. The fastening arms 31 are arranged at regular intervals along a horizontal diagonal line with the overall length thereof gradually lengthening from front to back. A top of an inner sidewall of the receiving cavity 131 of the main housing 10 protrudes towards the base body 11 to form a blocking eave 132. A free end of the touching arm 33 of the conductive terminal 30 further extends horizontally to form a blocking tail 34 blocked under the blocking eave 132 to avoid the touching arm 33 excessively rebounding by virtue of itself elasticity after the circuit board 80 is removed from the electrical connector.

Referring to FIG. 2, FIG. 3, FIG. 4 and FIG. 5, a bottom of a front inner wall of the receiving chamber 111 of the main housing 10 is concaved forward to form a transverse inserting groove 112. The top face of the tongue board 12 defines a plurality of terminal grooves 121 arranged at regular intervals along the transverse direction and longitudinally extending through the base body 11 to communicate with the receiving chamber 111 and the inserting groove 112 for receiving the contact arms 32 therein. A bottom of a front of the inner housing 20 has an inserting tongue 21 extending transversely to be inserted in the inserting groove 112 of the main housing 10. A plurality of inserting portions 22 are protruded on the inserting tongue 21 and arranged in accordance with the terminal grooves 121 to be inserted in the terminal grooves 121 opened in the base body 11.

A bottom face of the inner housing 20 defines a guiding groove 23 longitudinally penetrating therethrough and a rear middle of a top of the inner housing 20 protrudes upward to form a buckling block 24. A middle of a bottom inner wall of the receiving chamber 111 of the main housing 10 protrudes upward to form a guiding rib 113 extending longitudinally and inserted in the guiding groove 23 to guide the assembly of the inner housing 20 in the receiving chamber 111. A rear middle of a top inner wall of the receiving chamber 111 defines a buckling hole 114 buckling the buckling block 24 of the inner housing 20 therein to secure the inner housing 20 and the main housing 10 together.

Referring to FIG. 1, FIG. 2 and FIG. 5, the shielding shell includes a front shell 40 looped from a metal plate to show a rectangular tubular shape, and a rear shell 50 curved from a metal plate. The front shell 40 is mounted rearward to the main housing 10 with the tongue board 12 together with the contact arms 32 of the conductive terminals 30 being apart located therein. The rear shell 50 is covered to the bearing board 13 of the main housing 10 and the backs of the inner housing 20 and the base body 11.

Rear edges of the front shell 40 are concaved forward to form a plurality of T-shaped locking gaps 41. The rear shell 50 has an L-shaped rear plate 51 covering the backs of the inner housing 20 and the receiving cavity 131. A bottom edge of the rear plate 51 extends forward to form a bottom plate 52 against bottom faces of the bearing board 13 and the base body 11. A top edge and one side edge of the rear plate 51 and a front edge of the bottom plate 52 protrude forward to form a T-shaped locking slice 53 respectively. The locking slices 53 are locked in the corresponding locking gaps 41 to secure the front shell 40 and the rear shell 50 together. One side of the bottom plate 52 against the bottom face of the bearing board 13 has a front edge bent upward to form a fastening plate 54 with a locking hole 541 opened therein. A front of the bearing board 13 protrudes forward to form a locking block 134 buckled in the locking hole 541 of the fastening plate 54 to secure the rear shell 50 to the main housing 10.

Referring to FIG. 3, the other side face of the base body 11 of the main housing 10 opposite to the bearing board 13 protrudes sideward to form a first fixing structure 141. A part of the bottom plate 52 of the rear shell 50 against the bottom face of the bearing board 13 defines a through-hole 521. The bottom face of the bearing board 13 protrudes downward to form a second fixing structure 142 passing through the through-hole 521 of the rear shell 50. The fixing structures 141, 142 are used to fix the electrical connector in an external electronic product (not shown).

As described above, the electrical connector and the circuit board 80 are electrically connected with each other by way of the touching arms 33 of the conductive terminals 30 elastically abutting against the circuit board 80. It is rather short-time and convenient for mounting the circuit board 80 to the electrical connector. Moreover, the touching arms 33 of the conductive terminals 30 are easily removed from the circuit board 80 for the convenience of replacing the electrical connector when it doesn't work.

What is claimed is:

1. An electrical connector, comprising:

a main housing having a base body, a tongue board extending forward from a front of the base body, and a bearing board extending sideward from one side face of the base body, a top face of the bearing board defining a receiving cavity penetrating rearward through the bearing board, a back of the base body being concaved forward to form a receiving chamber penetrating sideward through the base body to communicate with the receiving cavity;

an inner housing disposed in the receiving chamber of the main housing;

a plurality of conductive terminals each having a fastening arm placed horizontally, one end of the fastening arm extending forward and being arched upward to form a contact arm, and the other end of the fastening arm extending sideward and being arched upward to form a touching arm perpendicular to the contact arm, the fastening arms being apart molded in the inner housing, the contact arms being arranged at regular intervals along a transverse direction in front of the inner housing and elastically projecting beyond a top face of the tongue board, and the touching arms being arranged at regular intervals along a longitudinal direction at one side of the inner housing, the touching arms being received in the receiving cavity of the main housing and elastically projecting upward beyond the top face of the bearing board; and a shielding shell enclosing the main housing and the inner housing, wherein an external circuit board is horizontally mounted on the bearing board with the touching arms of the conductive terminals being elastically against and further pressed downward by the circuit board to realize electrical connection with the circuit board.

2. The electrical connector as claimed in claim 1, wherein the fastening arm of the conductive terminal is substantially of a lying-L shape, the fastening arms are arranged at regular intervals along a horizontal diagonal line with the overall length thereof gradually lengthening from front to back.

3. The electrical connector as claimed in claim 2, wherein a top of an inner sidewall of the receiving cavity of the main housing protrudes towards the base body to form a blocking eave, a free end of the touching arm of the conductive terminal further extends horizontally to form a blocking tail blocked under the blocking eave.

4. The electrical connector as claimed in claim 1, wherein the top face of the bearing board of the main housing protrudes upward to form a pair of fastening pillars inserted in the circuit board to secure the circuit board on the bearing board.

5. The electrical connector as claimed in claim 1, wherein a bottom of a front inner wall of the receiving chamber of the main housing is concaved forward to form a transverse inserting groove, the top face of the tongue board defines a plurality of terminal grooves arranged at regular intervals along the transverse direction and longitudinally extending through the base body to communicate with the receiving chamber and the inserting groove for receiving the contact arms therein, a bottom of a front of the inner housing has an inserting tongue extending transversely to be inserted in the inserting groove of the main housing, a plurality of inserting portions are protruded on the inserting tongue and arranged in accordance with the terminal grooves to be inserted in the terminal grooves opened in the base body.

6. The electrical connector as claimed in claim 5, wherein a bottom face of the inner housing defines a guiding groove longitudinally penetrating therethrough and a rear middle of a top of the inner housing protrudes upward to form a buckling block, a middle of a bottom inner wall of the receiving chamber protrudes upward to form a guiding rib extending longitudinally and inserted in the guiding groove to guide the assembly of the inner housing in the receiving chamber, a rear middle of a top inner wall of the receiving chamber defines a buckling hole buckling the buckling block of the inner housing therein.

7. The electrical connector as claimed in claim 1, wherein the shielding shell includes a front shell looped from a metal plate to show a rectangular tubular shape, and a rear shell curved from a metal plate, the front shell is mounted rearward to the main housing with the tongue board together with the contact arms of the conductive terminals being apart located therein, the rear shell is covered to the bearing board of the main housing and the backs of the inner housing and the base body.

8. The electrical connector as claimed in claim 7, wherein rear edges of the front shell are concaved forward to form a plurality of T-shaped locking gaps, the rear shell has an L-shaped rear plate covering the backs of the inner housing and the receiving cavity, a bottom edge of the rear plate extends forward to form a bottom plate against bottom faces of the bearing board and the base body, a top edge and one side edge of the rear plate and a front edge of the bottom plate protrude forward to form a T-shaped locking slice respectively, the locking slices are locked in the corresponding locking gaps to secure the front shell and the rear shell together.

9. The electrical connector as claimed in claim 8, wherein one side of the bottom plate against the bottom face of the bearing board has a front edge bent upward to form a fastening plate with a locking hole opened therein, a front of the bearing board protrudes forward to form a locking block buckled in the locking hole of the fastening plate.

10. The electrical connector as claimed in claim 1, wherein the other side face of the base body of the main housing opposite to the bearing board protrudes sideward to form a first fixing structure, a part of the shielding shell against a bottom face of the bearing board defines a through-hole, the bottom face of the bearing board protrudes downward to form a second fixing structure passing through the through-hole of the shielding shell.

* * * * *